US005418069A

United States Patent [19]

Learman

[11] Patent Number: 5,418,069

[45] Date of Patent: May 23, 1995

[54] FORMABLE COMPOSITE MAGNETIC FLUX CONCENTRATOR AND METHOD OF MAKING THE CONCENTRATOR

[76] Inventor: Thomas J. Learman, P.O. Box 322, Grand Haven, Mich. 49417

[21] Appl. No.: 150,392

[22] Filed: Nov. 10, 1993

[51] Int. Cl.[6] ..... B22F 5/00; H01F 1/00

[52] U.S. Cl. ..... 428/551; 252/62.54; 252/62.55; 419/35; 419/36; 419/53; 419/65

[58] Field of Search ..... 252/62.54, 62.55; 428/551; 419/35, 36, 53, 65

[56] References Cited

U.S. PATENT DOCUMENTS

| | | | |
|---|---|---|---|
| 3,652,965 | 3/1972 | Krebs et al. | 335/277 |
| 3,789,059 | 3/1974 | Astle et al. | 117/212 |
| 4,197,146 | 4/1980 | Frischmann | 148/31.55 |
| 4,255,684 | 3/1981 | Mischler et al. | 310/216 |
| 4,486,641 | 12/1984 | Ruffini | 219/10.79 |
| 4,489,950 | 12/1984 | Chorney | 277/80 |
| 4,631,381 | 12/1986 | Delage et al. | 219/10.57 |
| 4,689,163 | 8/1987 | Yamashita et al. | 252/62.54 |
| 4,776,980 | 10/1988 | Ruffini | 252/513 |
| 4,832,891 | 5/1989 | Kass | 264/101 |
| 4,833,436 | 5/1989 | Martin et al. | 336/60 |
| 4,920,009 | 4/1990 | Lee et al. | 428/552 |
| 4,999,322 | 3/1991 | Reick | 501/83 |
| 5,088,976 | 2/1992 | Liboff et al. | 600/13 |
| 5,101,086 | 3/1992 | Dion et al. | 219/10.491 |
| 5,112,801 | 5/1992 | Nellis et al. | 505/1 |
| 5,126,611 | 6/1992 | Armstrong et al. | 310/90.5 |
| 5,130,588 | 7/1992 | Armstrong et al. | 310/90.5 |
| 5,196,547 | 3/1993 | Wilkinson et al. | 522/103 |

*Primary Examiner*—Donald P. Walsh
*Assistant Examiner*—John N. Greaves
*Attorney, Agent, or Firm*—Price Heneveld Cooper DeWitt & Litton

[57] ABSTRACT

A formable composite magnetic flux concentrator is composed of about 65 to 90 percent ferromagnetic material, such as iron powder, and about 35 to 10 percent binder, the binder being a mixture of an epoxy and one or more catalysts. The concentrator is provided in a formable state as a putty-like body which can be worked into any desired shape dictated by the configuration of the induction heating coil used in a particular application.

39 Claims, 1 Drawing Sheet

FORMABLE COMPOSITE MAGNETIC FLUX CONCENTRATOR AND METHOD OF MAKING THE CONCENTRATOR

BACKGROUND OF THE INVENTION

1. Field of the Invention

The present invention generally relates to induction heating and, more particularly, to a formable composite magnetic flux concentrator for use in induction heating applications. The present invention also relates to a method of making the concentrator.

2. Description of the Prior Art

Induction heating is a relatively efficient manner of generating heat in an electrically conductive part. When changing electrical current flows in an induction heating coil, it will cause a changing magnetic field to be generated about the coil. If the electrically conductive part is placed within the coil, then the changing magnetic field will induce a current to flow around the part which will generate heating of the part due to its inherent electrical resistance to the current flow. No contact is necessary between the coil and part. The magnetic flux field is passed through an air gap between the coil and part.

By placing a composite magnetic flux concentrator on the induction heating coil, a stronger magnetic field is generated in the air gap between the coil and part. The stronger the magnetic field, the faster and more efficiently the part will be heated. The magnetic flux concentrator is formed of a magnetically conductive material that, when placed on the coil, creates a more efficient and controlled magnetic flux path and increases the intensity of the magnetic flux field.

The use of a magnetic flux concentrator also has the following additional benefits. The concentrator (1) increases the magnetic coupling into the part, thus using less energy; (2) decreases the potential hazardous magnetic and RF exposure to which machine operators are exposed; (3) defines the specific area that is to be induction heated, thereby holding the heat affected zone to a controlled or minimum which is metallurgically beneficial to the part; and (4) allows the focusing/shielding of the magnetic energy into/from zones that would not otherwise be achievable without the use of the concentrator.

There are basically three different types of prior art magnetic flux concentrators in commercial use. The first type of prior art concentrator is provided in the form of laminations of numerous thin sheets of steel. Each sheet is electrically insulated from the other sheets. The laminations are custom fitted to the shape required and placed side by side over the coil. However, undesirably high eddy currents are generated within the sheets and excess heat energy is produced within the concentrator. At higher frequencies, thinner laminations must be used in order to keep eddy current generation to a minimum. Because of physical thickness limitations, this first type of concentrator is limited to relatively low frequency applications. Also, excess heat production requires cooling of the laminations which is labor intensive and expensive. Thus, the problems associated with the laminated type of concentrator is the amount of labor required for custom fabrication, the expense and difficulty in cooling, the difficulty in repairing laminations, and the limitation of use to relatively low frequencies.

The second type of prior art concentrator is a ferrite. The ferrite is an iron alloy crystal that is pressed into a form that has in itself been custom fitted to the coil. The formed substance is then fired at very high temperature in an oxygen-free oven to form a ceramic-like material. Being of a ceramic-like material, the concentrator will fracture if heating is not uniform. When a part is heated it increases in heat energy and, in turn, radiates heat energy into the work coil and the concentrator. The radiant heating oftentimes causes uneven heating of the material. Being a hard, stone-like material, the ceramic-like concentrator is all but impossible to water cool, without generating thermal stresses.

The third type of prior art concentrator is a machinable bar made by combining very small insulated iron powdered metal particles and small amounts of binder. This combination is then placed in a mold and pressed with a force of over 2000 pounds per square inch while heat is applied. Once formed the bar must be machined to fit the coil shape needed. This type of concentrator is able to work at higher frequencies than the laminated material because of the insulating abilities and low hysteresis losses of the small powders. However, when large time variable magnetic fluxes are applied for long periods of time, the need to water cool the concentrator still exists. The bar concentrator is expensive to form, labor intensive to machine, and difficult to water cool.

Consequently, a need still exists for improvement of magnetic flux concentrators and of techniques for fabrication which will overcome the problems associated with the prior art types of concentrators described above.

SUMMARY OF THE INVENTION

The present invention satisfies the aforementioned needs by providing a formable composite magnetic flux concentrator and a method of making the concentrator. The composite concentrator of the present invention provides a route through which magnetic flux flows, but due to its formulation the composite concentrator itself heats only insignificantly in the changing magnetic field. The composite concentrator is putty-like in consistency and is hand-formable to be placed on an induction heating coil for custom fit specific to that coil. The composite material of the concentrator can perform the energy-saving function in the "putty" state. This allows the composite material to be tested in the work environment prior to hardening. Once fitted and tested, the assembly of the induction heating coil and composite material can be oven-baked to harden the putty-like composite material into a solid material for stability and permanency.

In accordance with the present invention, the magnetic flux concentrator is a composition comprising a ferromagnetic material in a percent by weight range of from about 65% to 90% and a binder in a percent by weight range of from about 35% to 10%. The binder may a mixture of an epoxy and one or more catalysts. Or, the binder may be one which will harden without the presence of a catalyst when heated to between about 380° F. to 400° F. The concentrator is provided in a formable state as a putty-like body which may be worked into any desired shape dictated by the particular application.

Also, in accordance with the present invention, the method of making the concentrator includes the steps of preparing a body in a formable putty-like state by mixing a ferromagnetic material and a binder and then shaping the body while in the formable putty-like state into the desired shape. After the desired shaping of the body is completed, the method further includes the step of solidifying the body by applying of heat to activate the catalyst of the binder to change the formable body to a solid body having the desired shape. Catalysts may be used in the binder which will start to react at different temperatures.

Prior to heating and while the body is in the formable putty-like state, the method may also include the step of adding a dry colored powder to a coating material to indicate a formulation assigned to the concentrator. Then, the coating material is applied to the body to form a dry shell about the body so that the body will hold its desired shape. As an alternative, fumed silicas, in a percent by weight range of from 0.01 (a trace) to 6 of the total composition of the body, may be added to eliminate the need to apply a shell to the body to retain its shape during heating.

Also, while the body is still in the formable putty-like state, the method may include the step of embedding hollow elements, such as hoses or tubing, in the formable composite body before it is solidified to provide a means by which the concentrator can be cooled during use. Further, the method may include the step of graining the body. In applying graining or magnetic flux paths to the body, a magnetic field is applied to the body in the direction of the proposed end use of the concentrator in order to displace the binder from between the magnetic particles and thereby increase the magnetic conductivity in the direction of use.

These and other features and advantages of the present invention will become apparent to those skilled in the art upon a reading of the following detailed description wherein there is described illustrative embodiments of the invention.

BRIEF DESCRIPTION OF THE DRAWING

In the following detailed description, reference will be made to the attached drawings in which.

DETAILED DESCRIPTION OF THE INVENTION

Figure 1:
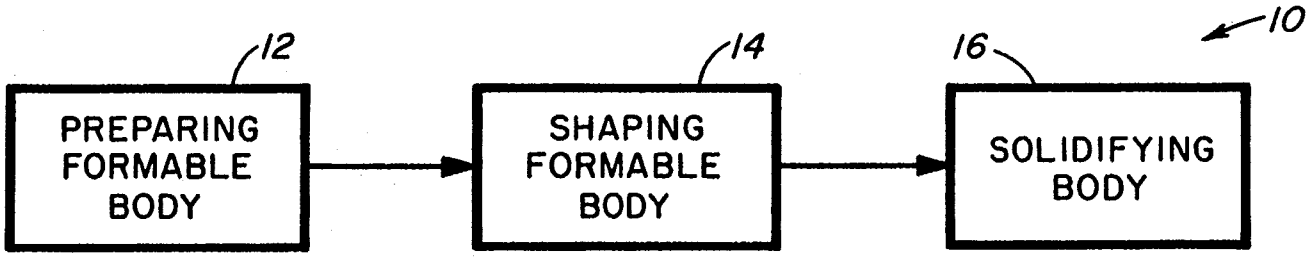
FIG. 1 is a general flow diagram of a method for making a putty-like formable composite magnetic flux concentrator in accordance with the present invention.

Referring to the drawings, and more particularly to FIG. 1, there is illustrated a general flow diagram 10 of the method of making a formable composite magnetic flux concentrator of the present invention. The method includes the basic steps of, initially, preparing a body in a formable putty-like state, as per block 12, by mixing together a ferromagnetic material and a binder and, next, shaping the body, as per block 14, while in the formable putty-like state into a selected shape. The formable putty-like state of the body permits the body to be worked by hand or otherwise into any desired selected shape as dictated by the configuration of an induction heating coil being used in a particular application. In a final basic step of the method, the body is solidified, as per block 16, by applying heat thereto to activate a catalyst of the binder to change the formable body having the selected shape to a solid body.

The ferromagnetic material incorporated in the composition of the concentrator is provided in a percent by weight range of from about 65% to 90% and the binder incorporated in the composition of the concentrator is provided in a percent by weight range of from about 35% to 10%. In a preferred composition suitable for use at low frequencies of from about 60 Hz to about 20 KHz, a level of about 90 percent by weight of ferromagnetic material and 10 percent by weight of binder can be employed. In a preferred composition suitable for use at higher radio frequencies of from about 50 KHz to about 500 KHz, a level of about 87 percent by weight of ferromagnetic material and 13 percent by weight of binder material can be employed.

The binder may be a mixture of a high viscosity epoxy and one or more non-active catalysts. The catalysts are employed to react with and activate the epoxy upon the application of heat to the body in a subsequent step in which the formable body is hardened to a permanent solid body. Preferably, two catalysts can be used in the binder which will start to react at different temperatures. The reason for using more than one temperature catalyst is to start to react the epoxy at a low temperature because as the epoxy is heated it decreases in viscosity. The low temperature catalyst starts to harden the thinning epoxy as it is heated in the oven. Then, the second higher temperature catalyst which is stronger than the first catalyst completes the reaction of the epoxy at a higher temperature.

Alternatively, the binder may be a material, such as a heat curable maleimide type resin, which will harden without the presence of a catalyst when heated to elevated temperatures, such as between about 380° F. to 400° F.

The ferromagnetic material employed in the composition of the magnetic flux concentrator of the present invention can be a high purity annealed iron powder prepared by electrolytic deposition. Preferably, the ferromagnetic material is an iron powder having particles of a first diameter size and a second diameter size smaller than the first diameter size.

The preferred materials have a total carbon content of less than about 0.01 percent and a hydrogen loss of less than about 0.30 percent. In a preferred embodiment, the loose iron powder employed in the composition of the concentrator of the present invention has an apparent density of greater than about 2.00 grams per cubic centimeter. Preferred materials possess the range of about 100 mesh, with less than about 3 percent having a particle size (tyler) of greater than 100 mesh (i.e., greater than 149 μm and less than about 44 μm). Such materials preferably have an average particle size in the range of about 40 to 70 μm; most preferably about 50 μm. To this material, smaller spherical particles are added, such smaller particles being in the size range of 2 to 10 μm and preferably about 5 μm. The addition of the smaller diameter particles permits a higher density composition to be achieved without the need to compress at high pressure.

The way to determine how much smaller diameter particles can be suspended in the larger diameter particles is as follows. A known weight of the larger diameter particles is placed in a graduated cylinder. Then smaller diameter particles are added and mixed within the graduated cylinder with the larger diameter particles without increasing the volume of the material in the cylinder. At some point the volume will increase with the addition of more of the smaller diameter particles. At that point the maximum amount of smaller particles that can be suspended or displaced in the larger particles is reached. By weighing the two powder mixture and subtracting the weight of the starting larger particle powder, the weight of the smaller particle powder and thereby the ratio of the larger to smaller powders can be determined. Further, this process can be repeated for the next smaller size particle powder.

Another important property of the iron powder employed in the composition is the particular shape. High purity annealed electrolytically-produced iron powders described above can be characterized as being predominately non-spherical, disc-shaped materials and mixed with spherical particles. This combination of shapes produces the following important advantage. The combination of shapes allows the use of much higher ratios of ferromagnetic material to binder material than other iron materials frequently employed such as carbonyl iron powders.

Other materials may be optionally employed in the composition of the concentrator. For example, an insulating material may be employed, to eliminate eddy current flow between the adjacent particles. In general, the insulating material includes acid phosphates; phospheric acid is particularly preferred as an insulating material and is present in an amount of from about 0.1 to about 1 percent by weight based on the total composition.

The epoxy of the binder is a polymeric resin or mixture of resins. Typical of the preferred resins are the resins of the nylon, fluorocarbons, epoxy and hot melt adhesive types or classes. These are generally characterized by their ability to provide a formable putty and particle-to-particle insulation after forming. The binder is used to hold the iron particles together and to form a putty both before and after forming and hardening.

After the putty-like body is formed, powders of insulated iron particles of different sizes and shapes can be added to form a skin thereon that will decrease the slight tacky surface on the outside of the unhardened putty. The powders will improve the magnetic conductivity by decreasing the distance between each particle. The outside of the unhardened putty could also be coated with dry powdered paint.

As mentioned above, after the desired shaping of the body is complete and after placing the body on the induction heating coil and further after adding a shell on the body and testing the body, the final basic step of the method takes place, which is, solidifying the body by applying heat to activate the catalyst or catalysts of the binder to change the formable body to the solid body. The catalysts are employed to react with and activate the epoxy, upon the application of heat to the formable body, and thereby hardened to a permanent solid body.

Figure 2:
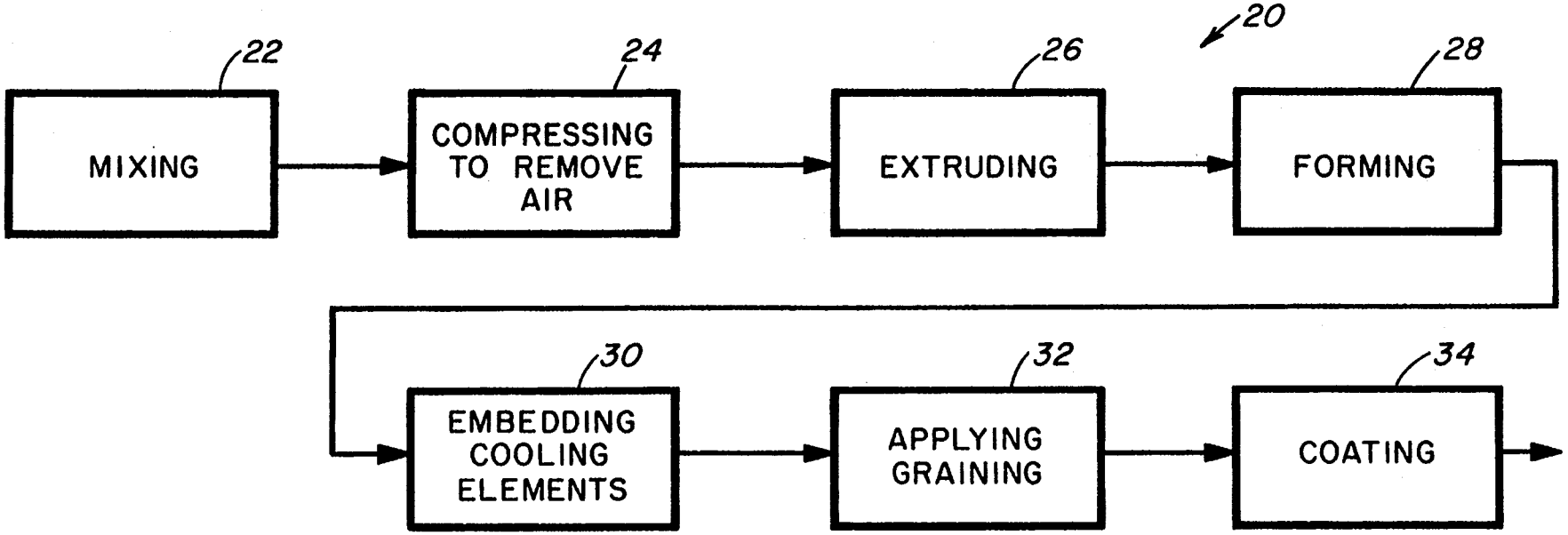
FIG. 2 is a detailed flow diagram of the method for making the magnetic flux concentrator.

Referring to FIG. 2, there is illustrated a more detailed flow diagram 20 of the method of making a formable composite magnetic flux concentrator of the present invention. The above-described step of preparing the formable putty-like body can be carried out by, first, mixing or blending the ferromagnetic material and polymer binder together, as per block 22; next, compressing the mixture, such as in a tube, in a vacuum chamber to remove air from the mixture, as per block 24; and then extruding the mixture, as per block 26, to provide the formable body.

The above-described step of shaping the formable body while in the formable putty-like state into the desired selected shape can be carried out by, first, working, shaping or forming the body, as per block 28, by hand into the desired shape or by placing the body in a cavity of the required shape and molding or forming the body into the desired shape. Any geometric shape, for example square, rectangular, torroidal, circular, etc., can be achieved that is required to concentrate the magnetic flux field to the appropriate situs on the workpiece. Also, the shape can be selected to direct, redirect or block the field.

Next, if desired, the body can be embedded, as per block 30, with hollow elements, such as hose or tubing while the body is in formable putty-like state to provide a means by which the concentrator can be cooled during use. Cooling by passing air or a gas through the tubing may be needed to remove radiant energy generated by the high temperature condition of the work part.

Following next, the shaping step includes graining the body, as per block 32, while in the formable putty-like state by applying a magnetic field thereto in the direction of the proposed end use of the concentrator. Testing is performed after the graining step and after the next described step of coating to ensure that the graining or magnetic flux paths are provided in the desired orientation.

In order to hold the desired selected shape of the body during the final step of solidifying the body, the shaping step may also include the step of applying a coating material, such as a mixture of plaster of paris and water, to the body, as per block 34, such as by painting it on the body and by baking or drying it in an oven, to form a dry rigid shell thereof about the exterior of the body. Plaster of paris uses the water to form a bond. When heated above 212° F., this bond is eliminated and the dry plaster of paris can easily be removed. A wetting agent may be applied before the coating material in order to assist in uniformly applying the coating material. Also, a dry colored powder may be added to the coating material to indicate a formulation assigned to the concentrator. It should be understood that the graining step can either preceed or follow the coating step.

As an alternative to the performance of the coating step, a fumed silica may be added to the ferromagnetic material and binder to assist the formed body in holding its shape during the subsequent solidifying step. The amount of fumed silica added is preferably within the range of from about 0.01 (trace) to 6 percent by weight of the total composition of the concentrator body.

The above-described step of solidifying the body includes applying heat to the body to activate the catalysts of the binder to change the formable body having the selected shape to a solid body. Preferably, two catalysts are used in the binder which start to react at different temperatures. For example, the putty-like body will start to harden upon reaction of the first catalyst at a lower temperature, such as 180° F. The shape of the body is thereby held at this lower temperature and completely converts to the solid body upon reaction of the second catalyst at a higher temperature, such as 300° F. The solidifying step can be carried out with the formable body applied to the induction heating coil such that the heat is applied to both the coil and body.

It also is apparent that this formulation or material could be used in applications other than induction heating where formable high frequency magnetic conductive material is required or needed.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A formable composite magnetic flux concentrator, comprising a composition of:
(a) a ferromagnetic material, in a percent by weight range of from 65% to 90%;
(b) a binder, in a percent by weight range of from 35% to 10% wherein said binder includes at least two catalysts which start to react at different temperatures.

2. The concentrator of claim 1 wherein said ferromagnetic material is an iron powder having particles of a first diameter size and a second diameter size different than said first diameter size.

3. The concentrator of claim 2 wherein said particles of said first diameter size are predominately non-spherical, disc-shaped particles, and said particles of said second diameter size are predominately spherical-shaped particles.

4. The concentrator of claim 1 wherein said binder is a mixture of an epoxy and at least two catalysts.

5. The concentrator of claim 1 wherein said composition provides a putty-like body in a formable state which can be hand-worked into different selected shapes.

6. The concentrator of claim 5 wherein an insulated powder is added to said composition to form a skin thereon that decreases a slightly tacky surface on an outside of said putty-like body.

7. The concentrator of claim 5 further comprising:
a dry shell of a coating material applied to said body so as to hold said body in the selected shape.

8. The concentrator of claim 7 wherein said coating material is made from a mixture of plaster of paris and water.

9. The concentrator of claim 8 wherein said coating material is also includes a dry colored powder being can be added to said dry plaster of paris to indicate a formulation assigned to said concentrator.

10. The concentrator of claim 1 wherein said composition also includes a fumed silica, in a percent by weight within the range of from about 0.01% to 6%.

11. A formable composite magnetic flux concentrator, comprising a putty-like body in a formable state which can be hand-worked into different selected shapes, said body having a composition comprising:
(a) a ferromagnetic iron material, in a percent by weight range of about 65% to 90%; and
(b) a binder, in a percent by weight range of about 35% to 10% wherein said binder includes at least two catalysts which start to react at different temperatures.

12. The concentrator of claim 11 further comprising:
a dry shell of a coating material applied to said body so as to hold said body in the selected shape.

13. The concentrator of claim 12 wherein said coating material is made from a mixture of plaster of paris and water.

14. The concentrator of claim 13 wherein said coating material is also includes a dry colored powder being can be added to said dry plaster of paris to indicate a formulation assigned to said concentrator.

15. The concentrator of claim 11 wherein said ferromagnetic material is an iron powder having particles of a first diameter size and a second diameter size being different than said first diameter size.

16. The concentrator of claim 15 wherein said particles of said first diameter size are predominately non-spherical, disc-shaped particles and said particles of said second diameter size are predominately spherical-shaped particles.

17. The concentrator of claim 11 wherein said binder is a mixture of a high viscosity epoxy.

18. The concentrator of claim 11 wherein said composition also includes a fumed silica, in a percent by weight within the range of from about 0.01% to 6%.

19. A method of making a formable composite magnetic flux concentrator, comprising the steps of:
(a) preparing a body in a formable putty-like state by mixing together a ferromagnetic material and a binder, wherein said binder includes at least two catalysts which start to react at different temperatures; and
(b) shaping said body while in said formable putty-like state into a selected shape.

20. The method of claim 19 wherein said preparing of said body includes mixing said ferromagnetic material in a percent by weight in the range of about 65% to 90%, with said binder, in a percent by weight range of about 35% to 10%.

21. The method of claim 20 wherein said binder is a mixture of an epoxy and at least one catalyst.

22. The method of claim 19 further comprising: solidifying said body by applying heat to said body to activate a catalyst of said binder to change said formable body having the selected shape to the solid body.

23. The method of claim 19 wherein said shaping includes applying a coating material to the body to form a dry shell thereof about the exterior of the body so that the body will hold said selected shape.

24. The method of claim 23 further comprising: solidifying said body by applying heat to said body to activate a catalyst of said binder to change said formable body having the selected shape to the solid body.

25. The method of claim 23 wherein said shaping includes adding a dry colored powder to the coating material to indicate a grade assigned to the concentrator.

26. The method of claim 19 wherein said preparing includes adding a fumed silica to the ferromagnetic material and binder.

27. The method of claim 26 wherein the fumed silica is within the range of from about 0.01 (trace) to 6 percent by weight of the total composition of the concentrator body.

28. The method of claim 19 wherein said shaping includes embedding hollow elements in the body while the body is in said formable putty-like state to provide a means by which the concentrator can be cooled during use.

29. The method of claim 19 wherein said shaping includes graining the body while the body is in said formable putty-like state by applying a magnetic field to the body in the direction of the proposed end use of the concentrator.

30. A method of making a formable composite magnetic flux concentrator, comprising the steps of:
(a) preparing a body in a formable putty-like state by mixing together a ferromagnetic material and a binder, said ferromagnetic material being in a percent by weight in the range of about 65% to 90% and said binder being in a percent by weight range of about 35% to 10% wherein said binder includes at least two catalysts which start to react at different temperatures;

(b) shaping said body while in said formable putty-like state into a selected shape; and (c) solidifying said formable body by applying heat to said body to cause said binder to change said formable body having the selected shape to the solid body.

31. The method of claim 30 wherein said binder is a mixture of an epoxy and at least two catalysts.

32. The method of claim 30 wherein said shaping includes applying a coating material to the body to form a dry shell thereof about the exterior of the body so that the body will hold said selected shape.

33. The method of claim 32 wherein said shaping includes adding a dry colored powder to the coating material to indicate a formulation assigned to the concentrator.

34. The method of claim 30 wherein said preparing includes adding a fumed silica to the ferromagnetic material and binder.

35. The method of claim 34 wherein the fumed silica is within the range of from about 0.01 to 6 percent by weight of the total composition of the concentrator body.

36. The method of claim 30 wherein said shaping includes embedding hollow elements in the body while the body is in said formable putty-like state to provide a means by which the concentrator can be cooled during use.

37. The method of claim 30 wherein said shaping includes graining the body while the body is in said formable putty-like state by applying a magnetic field to the body in the direction of the proposed end use of the concentrator.

38. The method of claim 30 wherein said ferromagnetic material is an iron powder having particles of a first diameter size and a second diameter size different than said first diameter size.

39. The method of claim 30 wherein said binder will harden without the presence of a catalyst when heated to between about 380° F. to 400° F.

* * * * *